US006168894B1

(12) United States Patent
Aoki et al.

(10) Patent No.: US 6,168,894 B1
(45) **Date of Patent: *Jan. 2, 2001**

(54) IMAGE FORMING METHOD AND DRY TONER THEREFOR

(75) Inventors: Mitsuo Aoki, Numazu; Hachiro Tosaka, Shizuoka-ken; Hiroyuki Fushimi, Numazu; Masanori Suzuki; Akihiro Kotsugai, both of Shizuoka-ken, all of (JP)

(73) Assignee: Ricoh Company, Ltd., Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/710,255

(22) Filed: Sep. 13, 1996

(30) Foreign Application Priority Data

Sep. 14, 1995 (JP) ..... 7-262214
Feb. 15, 1996 (JP) ..... 8-050788
Sep. 11, 1996 (JP) ..... 8-262542

(51) Int. Cl.[7] ..... G03G 13/20; G03G 9/083; G03G 9/087

(52) U.S. Cl. ..... 430/99; 430/106.6; 430/109; 430/110; 430/111; 430/124

(58) Field of Search ..... 430/110, 109, 430/106.6, 111, 99, 124; 399/330, 331, 328, 333; 427/194, 195

(56) References Cited

U.S. PATENT DOCUMENTS 4,837,138 * 6/1989 Horie ..... 430/106
5,079,123 * 1/1992 Nanya et al. ..... 430/106.6
5,306,593 * 4/1994 Cunningham et al. ..... 430/137
5,334,471 * 8/1994 Sacripante et al. ..... 430/106.6
5,480,756 * 1/1996 Mahabadi et al. ..... 430/109
5,501,931 * 3/1996 Hirama et al. ..... 430/109
5,614,347 * 3/1997 Aoki et al. ..... 430/109

OTHER PUBLICATIONS

R.M. Schaffert, *Electrophotography*, John Wiley & Sons, NY. (1975), pp. 56–57.*

* cited by examiner

*Primary Examiner*—Janis L. Dote
(74) *Attorney, Agent, or Firm*—Oblon, Spivak, McClelland, Maier & Neustadt, P.C.

(57) ABSTRACT

An image forming method including a new toner fixing method and toner therefor, wherein the method includes two rollers in which a toner image on an image supporting material is fixed by heating at a nipped section of the rollers, wherein one of the rollers which is a fixing roller contacting the toner image includes a metal cylinder having a thickness of not more than 1.0 mm, and the fixing pressure of the two rollers is not more than $1.4\times10^5$ Pa, and wherein the toner contains resins including two polyester resins, (A) and (B), and the polyester resin (B) includes discrete domains of the polyester resin (A) which has higher glass transition Tg and higher molecular weight than those of the polyester resin (B) and includes a component insoluble in tetrahydrofuran, and wherein the developed image can be fixed at relative low temperature and in wide temperature range, and the fixed image has excellent image quality and preserving property.

40 Claims, 1 Drawing Sheet

IMAGE FORMING METHOD AND DRY TONER THEREFOR

BACKGROUND OF THE INVENTION

Field of the Invention

The present invention relates to an image forming method and dry toner useful for developing an electrostatic latent image formed by electrophotography, electrostatic recording and electrostatic printing and the like, and more particularly to an image forming method and dry toner therefor in which a developed toner image is fixable at relatively low temperatures and in a wide temperature range, the printed image having excellent printing and preserving property without contaminating an image forming apparatus.

DISCUSSION OF THE BACKGROUND

A variety of methods using electrophotography for obtaining a printed image have been disclosed in, for example, U.S. Pat. No. 2,297,691 and Japanese Pat. Publications Nos. 49-23910 and 43-24748, incorporated herein by reference. Generally, these methods include the following steps:

(a) an electrostatic latent image is formed on a electrophotoconductor by various methods;

(b) the electrostatic latent image is developed with toner;

(c) the developed toner image is transferred to a recording material such as, paper and the like, if desired; and (d) the transferred toner image (hereinafter referred to as a toner image) is fixed by application of heat, pressure or organic solvent vapor to obtain a printed image.

Developing methods of an electrostatic latent image are broadly classified into two types. The first type of the developing methods is a liquid toner developing method using liquid toner which is made by dispersing a pigment and/or a dye in an insulating organic liquid. The second type of the developing methods is a dry toner developing method such as, for example, cascade developing method, magnetic brush developing method and powder cloud developing method, which uses dry toner made by dispersing a coloring agent such as, carbon black and the like, in a natural resin or a synthetic resin. Recently, the dry toner developing method has been widely used for electrophotography.

As fixing methods used for a developed image with dry toner (hereinafter referred to as toner), a heat roller fixing method is widely used because of the high efficiency of heating. Recently, the heat energy used for fixing has tended to decrease because of high speed fixing (for high speed printing) and relatively low temperature fixing (in order to save energy). In attempting to improve this situation, an improved fixing unit has been developed in which a cylindrical fixing roller to contact a toner image side of a recording material has thickness of not more than 1.0 mm. This improved fixing unit has the advantage of excellent efficiency of heat energy. However, the unit has a disadvantage of uneven fixation of toner image caused by bending generated by application of pressure for fixing. Therefore, toner used for this improved fixing unit is required to be fixable at relatively low temperatures beyond comparison with current toner because the heat rollers of the improved fixing unit must be applied with relatively low fixing pressure to prevent bending. Low temperature fixable toner used for the improved fixing unit is proposed which includes a resin or a wax having a relatively low melting point. However, the low temperature fixable toner tends to be blocked (hereinafter referred to as blocking) even at the inner temperature of an image forming apparatus or the general preserving temperature during a year and has too narrow a fixing temperature range to keep obtaining good printed images even when using a polyester resin which has both low temperature fixing property and good preservability.

In order to solve this problem, a plurality of improved low temperature fixable toners including two polyester resins having different physical properties are disclosed. For example, Japanese Laid-Open Pat. Application No. 60-90344 discloses toner including a mixture of a non-linear polyester resin and a linear polyester resin. Japanese Laid-Open Pat. Application No. 64-15755 discloses toner including a mixture of a crosslinked polyester resin, which has glass transition temperature Tg of at least 50° C. and softening point of not more than 200° C., and a linear polyester resin which has softening point of not more than 150° C. and weight-average molecular weight MW of from 3,000 to 50,000. Japanese Laid-Open Pat. Application No. 2-82267 discloses toner including a non-linear polyester resin which has weight-average molecular weight MW of at least 5,000 and the ratio of weight-average molecular weight Mw to number-average molecular weight Mn, (Mw/Mn), of at least 20 and another non-polyester resin which has MW of from 1,000 to 5,000 and Mw/Mn of not more than 4. Japanese Laid-Open Pat. Application No. 3-229264 discloses toner including a linear polyester resin having acid value of from 5 to 60 mg KOH/g, a non-linear polyester resin having acid value of smaller than 5 mg KOH/g and an organic metal compound. Japanese Laid-Open Pat. Application No. 3-41470 discloses toner including two saturated polyester resins having different acid values in which the ratio of the large acid value to the small acid value is at least 1.5. However, fixing temperature is recently being set lower and lower; therefore, these toners become unavailable for the improved fixing unit having a thin thickness fixing roller with low fixing pressure referred to above, because the toner does not have satisfactory fixing property such as, low temperature fixability and a wide enough fixable temperature range to be used for the improved fixing unit, and does not provide excellent preservability.

In addition, as the demand for high quality printed image continues to grow, the diameter of a toner particle becomes smaller and smaller. However, as the diameter of a toner particle becomes smaller, there occur a variety of problems which include apparatus contamination by toner scattering and fouling on printed images. In an attempt to solve these problems, a developer is proposed in which a magnetizable material is included in a two-component toner to hold the toner to a magnetic developing roller. For example, Japanese Laid-Open Pat. Application No. 58-216256 discloses two-component developer having carrier and toner which includes a magnetizable material and a fine electroconductive material. Japanese Laid-Open Pat. Application No. 3-42675 discloses two-component magnetic developer having carrier and toner which includes a magnetizable particle and a condensation polyester resin. However, these magnetizable particles are too large to be dispersed in a fine toner particle used for the image quality improved image forming apparatus described above.

Because of these reasons, a need exists for a toner useful for improved image forming methods having excellent fixing properties such as low temperature fixability and a wide fixable temperature range and which can be used for high speed and high heat efficient fixing units having a thin fixing roller and using low fixing pressure. Toners providing excellent preservability in addition to these other properties is also needed.

OBJECTS OF THE INVENTION

Accordingly, one object of the present invention is to provide an image forming method and toner for developing electrostatic latent images, in which a toner image is fixed at relatively low temperature for high speed and high efficient fixing, and toner and a fixed image have excellent preservability.

Another object of the present invention is to provide an image forming method and toner therefor in which a toner image is fixable in a wide temperature range for obtaining uniform printing images.

Yet another object of the present invention is to provide an image forming method and a fine particle toner therefor which can print excellent images without apparatus contamination and fouling on printed images.

SUMMARY OF THE INVENTION

The above objects and other objects of the present invention which will become apparent from the following description are achieved by an image forming method and toner therefor.

The image forming method of the present invention is useful for an image forming apparatus having a high heat efficient fixing unit including two rollers in which a toner image is fixed by heating at a nipped section of the two rollers, wherein one of the two rollers which is a fixing roller to be contacted with a toner image includes a metal cylinder having a thickness of not more than 1.0 mm, and the fixing pressure {i.e. (load between two rollers)/(contacting area of the two rollers)} of the two rollers is not more than $1.5\times10^5$ Pa.

The toner of the present invention includes two polyester resins, (A) and (B), wherein the resin (B) includes discrete domains of the polyester resin (A).

In an alternative embodiment, the polyester resin (A) includes an insoluble component in tetrahydrofuran and the glass transition temperature and the molecular weight of polyester resin (A) are higher than those of the polyester resin (B).

In another embodiment, the acid values of the polyester resin (A) and the polyester resin (B) are smaller than about 20 mg KOH/g and at least about 20 mg KOH/g, respectively.

In yet another embodiment, the glass transition temperature of the polyester resin (B) is from about 52 to 60° C.

In still another embodiment, an insoluble component in tetrahydrofuran is present in the polyester resin (A) in an amount of from about 5 to 60% to the total weight of the polyester resin (A).

In a further embodiment, the toner includes carnauba wax which is subjected to a treatment eliminating free aliphatic acids therefrom.

In a still further embodiment, the toner includes a hydrogenated petroleum resin, the hydrogenation rate of which is at least about 50%.

In a still further embodiment, the toner includes a magnetizable material whose particle diameter is from about 0.01 to 0.20 $\mu$m.

Therefore, according to the present invention, an improved image forming method and toner therefor in which a toner image has excellent fixing properties and the printed image has excellent image quality and preservability without apparatus contamination are provided for utilization in a plurality of areas of information recording.

These and other objects, features and advantages of the present invention will become apparent upon a consideration of the following description of the preferred embodiments of the present invention taken in conjunction with the accompanying drawing.

DESCRIPTION OF THE PREFERRED EMBODIMENTS

Figure 1:
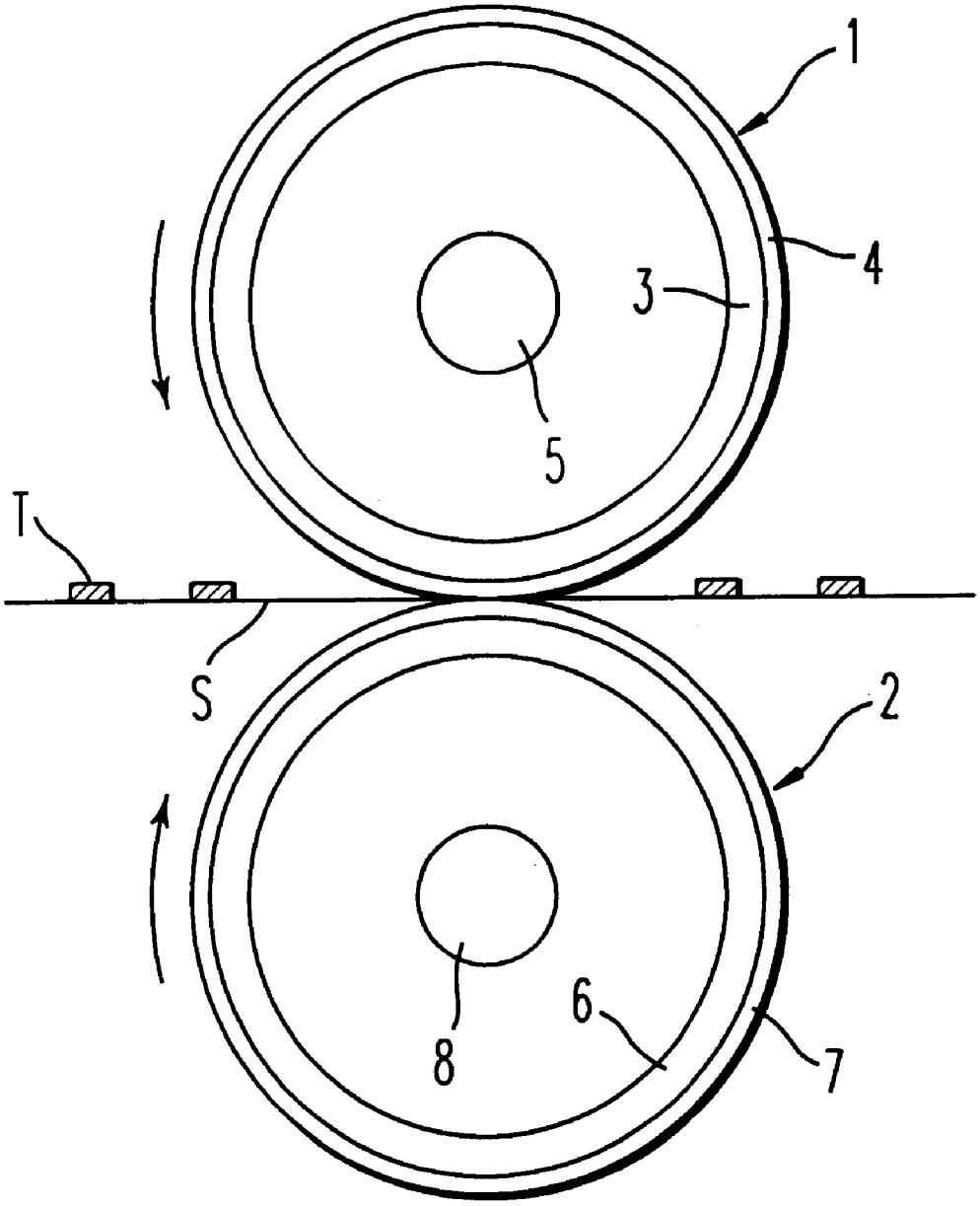
FIG. 1 shows a schematic diagram of a fixing unit including an embodiment of the present invention.

According to the present invention, there is provided an improved image forming method and toner therefor having the following advantages over conventional image forming methods: (a) the image forming method of the present invention includes a fixing unit which has high speed fixability and high heat efficiency, and includes two rollers in which a toner image is fixed by heating at a nipped section of the two rollers, wherein one of the two rollers which is a fixing roller to be contacted with a toner image includes a metal cylinder having a thickness of not more than 1.0 mm, and the fixing pressure {i.e. (load between two rollers)/(contacting area of the two rollers)} of the two rollers is not more than $1.5\times10^5$ Pa; and (b) the toner image developed with the toner of the present invention is fixed at relatively low temperature, fixable in a wide temperature range, and the printed image has excellent image quality and preservability, especially when used in the image forming method of the present invention.

A suitable fixing unit for use in the present invention includes a heat roller fixing member in which a developed toner image is fixed by passing through the nipped section of two rollers as shown in FIG. 1. In FIG. 1, numeral 1 denotes a fixing roller, and numeral 2 denotes a pressure roller. The fixing roller 1 includes:

(a) a metal cylinder 3 made of a heat conductive metal such as, for example, aluminum, iron, stainless steel, brass or the like; and (b) an offset preventing layer 4 which is formed overlying the metal cylinder 3 and includes, for example, room temperature vulcanizing (RTV) rubber, silicone rubber, tetrafluoroethylene-perfluoroalkylvinylether copolymer (PFA), or polytetrafluoroethylene (PTFE). In the metal cylinder 3, a heat lamp 5 can be arranged. Other ways of heating can be used such as a resistance heater arranged on the inside of metal cylinder 3, etc. The metal cylinder 6 of the pressure roller 2 can be made of the same metal as the metal cylinder 3 of the fixing roller 1, and also overlain by an offset preventing layer 7 including PFA , PTFE or the like.

In addition, if desired, a heat lamp 8 is arranged in the pressure roller 2 or other heating means are used (see above). The fixing roller 1 and the pressure roller 2 are pressed together by means of, e.g., springs, arranged at the both sides of the rollers (not illustrated in FIG. 1), so that the two rollers rotate in the direction opposite to each other (pressure means). An image supporting materials which has a toner image T thereon is passed through the nipped section to fix the toner image.

The fixing unit for use in the present invention is an improved fixing unit which has a high heat rising property and which can be quickly raised (e.g., 5–15° C./sec) to predetermined fixing temperature (generally 150–190° C.) because the fixing roller includes a metal cylinder whose thickness is not more than 1.0 mm. The preferred thickness of the metal cylinder which depends on the strength and the heat conductivity of the material used for the cylinder is from about 0.2 to 0.7 mm including 0.3, 0.4, 0.5 and 0.6 mm as well as all ranges between these end points and subranges.

The preferred fixing pressure (plane pressure) between the fixing roller and the pressure roller is not more than $1.5\times10^5$ Pa. The plane pressure means the value in which the load between two rollers is divided by the contacting area of the two rollers. Measurements of the contacting area are carried out by the following methods:

(a) a sheet such a sheet for over head projection (OHP) that changes its surface condition when heated is passed through the nipped section of the two rollers;

(b) the sheet is stopped and stood between the nipped section for a couple to ten seconds; and (c) the area of the sheet whose surface is changed by heating is measured, which is the contacting area of the two rollers.

In general, the higher the pressure between the rollers becomes, the better the fixing property of the printed image. However, in the fixing unit having a fixing roller including a metal cylinder having a thickness of not more than 1.0 mm, large pressure cannot be subjected because of the bending of the roller. The preferred fixing pressure is thus not more than $1.5\times10^5$ Pa, more preferably from $0.4\times10^5$ to $1.0\times10^5$ Pa including 0.5, 0.6, 0.7, 0.8 and $0.9\times10^5$ Pa and all ranges and subranges between these several values.

Suitable toner for use in the present invention includes a polyester resin (A) (hereinafter referred to as resin (A))and another polyester resin (B) (hereinafter referred to as resin (B)), wherein the resin (B) includes discrete domains of the resin (A).

The polyester resins which may be used in the toner of the present invention include the known polyester resins which are obtained by condensation polymerization of an alcohol and a carboxylic acid. Specific examples of the alcohol include, but are not limited to;

ethyleneglycol, diethyleneglycol, triethyleneglycol, propyleneglycol, 1,4-bis(hydroxymethyl)cyclohexane, etherificated bisphenols such as bisphenol A, dihydric alcohol monomers, and polyhydric monomers having three or more hydroxy groups.

Specific examples of the carboxylic acid are as follows, but are not limited to;

dibasic organic acid monomers such as, for example, maleic acid, fumaric acid, phthalic acid, isophthalic acid, terephthalic acid, succinic acid, and malonic acid, and polybasic organic acid having three or more carboxyl groups such as, for example, 1,2,4-benzenetricarboxylic acid, 1,2,5-benzenetricarboxylic acid, 1,2,4-cyclohexanetricarboxylic acid, 1,2,4-naphthalenetricarboxylic acid, 1,2,5-hexanetricarboxylic acid, 1,3-dicarboxyl-2-methylenecarboxypropane, and 1,2,7,8-octanetetracarboxylic acid.

In the present invention, since the resin (B) must include discrete domains of the resin (A), the toner exhibits the different characteristics of the resin (A) and the resin (B) at the same time, resulting in improved low temperature fixability, widened fixable temperature range and increased preservability of the toner. When the resin (A) is not formed as discrete domains in the resin (B), the different characteristics of the resin (A) and the resin (B) are averaged, so that the improvements of low temperature fixability, fixable temperature range and preservability are not achieved. As the shape of domains, any shape can be used. The preferred diameter of a domain is from about 2 to 500 $\mu$m in order to keep excellent heat preservability, low temperature fixability and wide fixable temperature range and include 10, 50, 100, 150, 200, 250, 300, 350, 400 and 450 $\mu$m and all ranges and subranges between these several values. Measurements of a diameter of a domain are carried out by the following methods:

(a) toner is cut by a microtome to be a thin layer;

(b) a domain is observed by an electron microscope;

(c) the longest and the shortest diameter of a domain is measured, and average them to obtain an average diameter; and (d) the procedures of from (a) to (c) is repeated several times (3–5 times), and the average is the diameter of the domain.

Formation of a domain and control of a diameter of the domain are easily performed by changing kneading conditions such as kneading temperature and kneading time, and the mixing ratio of the resin (A) to the resin (B). Preferably, all of resin A exists as domains within resin B (island/sea). However, 70–99% of resin A as domains can be used.

The mixing ratio of the resin (A) to the resin (B) is preferably from 10/90 to 70/30, and preferably from 25/75 to 60/40.

In a preferred embodiment, the glass transition temperature Tg and molecular weight of the resin (A) are higher than those of the resin (B). The resin (A) having higher Tg and molecular weight works towards widening the fixable temperature range and the resin (B) having lower Tg and molecular weight is useful for further improving low temperature fixability. When the Tg and molecular weight of the resin (A) are lower than or equal to those of the resin (B), these effects cannot be obtained. The preferred weight-average molecular weight Mw of the resins (A) and (B), and the Tg of the resin (A) are from 3,000 to 50,000, from 2,000 to 40,000 and from about 54 to 65° C., respectively, in order to provide excellent low temperature fixability, wide fixable temperature range and excellent preservability. The Tg of the resin (B) which is a very important factor is preferably from about 52 to 60° C., and more preferably 54 to 58° C. in order to keep excellent preservability and low temperature fixability. Measurements of Mw are carried out by gel permeation chromatography (GPC) method. Measurements of Tg are carried out with a differential scanning calorimeter (DSC). Measurements of the Mw of the resin (A) are carried out of the resin (A) from which the insoluble component in tetrahydrofuran (hereinafter referred to as THF) is eliminated.

The preferred acid value of the resin (A) is smaller than about 20 mg KOH/g, and more preferably from 0.1 to 18 mg KOH/g including 2, 5, 10 and 15 mg/KOH/g and all ranges and subranges therebetween in order to maintain excellent charging ability without dependence on environmental conditions, particularly on humidity. The acid value of the resin (B) is preferably at least about 20 mg KOH/g, and more preferably from 25 to 600 mg KOH/g including 75, 150, 250, 350, 450 and 550 mg KOH/g and all ranges and subranges therebetween in order to keep high adhesive strength between the toner and an image supporting material and excellent low temperature fixability of the toner.

The content of the THF insoluble component in the resin (A) is preferably from about 5 to 60 wt. % to the total weight of the resin (A), and more preferably 10 to 50 wt. % in order to maintain a wide fixable temperature range and excellent low temperature fixability. The content of the THF insoluble component in the resin (A) is measured by the following methods:

(a) the resin (A) is solved in THF (named as liquid A);
(b) the liquid A is filtered with a wire net of 250 mesh;
(c) the residue on the wire net is dried and weighed; and
(d) the weight ratio of the residue to the resin (A) is calculated.

The toner of the present invention may further include other resins. One of the preferable resins which is effective for improving releasability of the toner is modified carnauba wax which is subjected to a treatment of eliminating free aliphatic acids from normal carnauba wax (hereinafter this wax referred to as modified carnauba wax). When free aliphatic acids are eliminated, carnauba wax can be easily and finely dispersed in toner, so that the releasability of the toner increases. In the toner of the present invention, a releasing agent such as modified carnauba wax is preferably dispersed in the resin (B) in order to obtain excellent releasability of the toner. The content of the modified carnauba wax to the toner is from 2 to 20 wt. %, and preferably from 3 to 10 wt. %.

Another preferable resin for use in the toner of the present invention which is effective for improving low temperature fixability and heat preservability is a hydrogenated petroleum resin. The preferable hydrogenated petroleum resin for use in the toner of the present invention has hydrogenation degree of at least about 50%, and more preferably at least 75%. When employing a hydrogenated petroleum resin having a hydrogenation degree of smaller than 50%, preservability tends to worsen, although low temperature fixability is maintained. Petroleum resins are made by refining and polymerizing a cracked oil fraction which is a by-product in the production of ethylene, acetylene, and propylene by cracking naphtha. The petroleum resins are constitutionally classified into, for example, aliphatic type petroleum resin including an aliphatic repeating unit having from 5 to 6 carbon atoms, aromatic type petroleum resin including an aromatic repeating unit having from 6 to 8 carbon atoms, and aliphatic/aromatic copolymer type petroleum resin made by polymerization of an aliphatic hydrocarbon and an aromatic hydrocarbon. Main raw materials of the petroleum resin are cyclopentadiene and higher olefins.

The preferred hydrogenated petroleum resin for use in the toner of the present invention includes an aliphatic/aromatic copolymer type petroleum resin having repeating units of dicyclopentadiene and an aromatic hydrocarbon having from 6 to 8 carbon atoms in order to maintain low temperature fixability and excellent preservability.

The preferred petroleum resin for use in the toner of the present invention has softening point of from about 90 to 140° C., and more preferably from 100 to 130° C. in order to keep excellent preservability and low temperature fixability. Measurements of softening point are carried out by a method based on JIS K6863-1994 (a measuring method of softening point of hot melt adhesive agents).

The preferred weight ratio of the petroleum resin to the total resins (polyesters and others) is from about 5 to 50 wt. %, and more preferably from 5 to 30 wt. % in order to keep low temperature fixability, excellent productivity in a process of pulverizing toner, and excellent preservability.

The toner of the present invention may preferably include a magnetizable material preferably having an average particle diameter of from about 0.01 to 0.20 μm in order to obtain toner having excellent image quality without fouling on printed images and apparatus contamination by making the toner firmly hold to a magnetic developing roller. The content of the magnetizable material in the toner is preferably from 20 to 40 wt. %.

Average particle diameter of the magnetizable material which may be used in the toner of the present invention is a result effective factor. When the average particle diameter becomes greater than 0.20 μm, the magnetizable material tends to be unevenly dispersed in toner, resulting in generation of fouling on printed images and apparatus contamination. The smaller the average particle diameter of the magnetizable material becomes, the better the dispersibility of the magnetizable material. However, when the average particle diameter comes smaller than 0.01 μm, the magnetizable material becomes almost a single crystal and cannot exhibit the above-mentioned effects because of its insufficient magnetization. Suitable magnetizable materials for use in the toner of the present invention include the known magnetizable materials such as ferrite, magnetite and the like. A small amount of metals such as nickel, cobalt and the like may be employed in addition to the above-mentioned magnetizable materials.

The most suitable magnetizable material for use in the toner of the present invention is magnetite. Measurements of average particle diameter is too small to be measured with a particle diameter measuring method using laser or the like, and carried out with a scanning electron microscope (SEM). The preferred content of the magnetizable material in the toner of the present invention is from 20 to 40 wt. % to keep excellent image quality such as high image density and excellent fixing property of the printed image without fouling on printed images, and to prevent apparatus contamination.

Other resins which may be used in the toner of the present invention include the known resins which can be employed in an amount which keep the advantages of the toner of the present invention (e.g., 0–50 wt. % based on toner weight). Specific examples of the resins are as follows but are not limited to:

polystyrene, chloropolystyrene, poly-α-methylstyrene, styrene/chlorostyrene copolymer, styrene/propylene copolymer, styrene/butadiene copolymer, styrene/vinylchloride copolymer, styrene/vinylacetate copolymer, styrene/maleic anhydride copolymer, styrene/acrylate copolymers, such as styrene/methyl acrylate copolymer, styrene/ethyl acrylate copolymer, styrene/butyl acrylate copolymer, styrene/octyl acrylate copolymer, and styrene/phenyl acrylate copolymer, styrene/methacrylate copolymers, such as styrene/methyl methacrylate copolymer, styrene/ethyl methacrylate copolymer, styrene/butyl methacrylate copolymer, and styrene/phenyl methacrylate copolymer, styrene/α-chloromethylacrylate copolymer, styrene/acrylonitrile/acrylate copolymer, vinylchloride resin, rosin modified maleic acid resin, phenolic resin, epoxy resin, polyethylene resin, polypropylene resin, ionomer resin, polyurethane resin, silicone resin, ketone resin, ethylene/ethyl acrylate copolymer, xylene resin, and polyvinylbutyral.

These resins may be employed individually or in a combination. In addition, suitable manufacturing methods of these resins include the known methods which are mass polymerization, solution polymerization, emulsion polymerization, suspension polymerization and the like.

The toner of the present invention may further include, if desired, coloring agents, charge controlling agents, releasing agents other than modified carnauba wax, and agents improving fluidity in addition to the polyester resins, modified carnauba wax and hydrogenated petroleum resin discussed above.

The coloring agents which may be used in the toner of the present invention, which may be employed individually or in a combination include known dyes, pigments, etc.

Specific examples of the coloring agents are as follows: carbon black, lamp black, iron black, aniline blue, phthalocyanine blue, phthalocyanine green, Hansa Yellow G, Rhodamine 6C lake, chalco-oil blue, chrome yellow, quinacridone, benzidine yellow, rose bengal, triallylmethane dye, and the like. Suitable content of the coloring agent in the toner is from 1 to 30 wt. % to the total resins (polyester and others), and more preferably from 3 to 20 wt. %.

The charge controlling agents which may be used in the toner of the invention, which may be employed individually or in a combination, include the known polarity controlling agents such as nigrosine dye, metal complex dye, quarternary ammonium salts and the like. Suitable content of the polarity controlling agent in the toner is from 0.1 to 10 wt. % to the total resins, and more preferably from 1 to 5 wt. %.

The releasing agents which may be used in the toner of the present invention, which may be employed individually or in a combination, includes the known releasing agents such as solid silicone varnish, higher fatty acid, higher alcohol, montan ester wax, oxidized rice wax, low molecular weight polyethylene wax and the like. Suitable content of the releasing agent in the toner is from 1 to 20 wt. % to the total resins, and preferably from 3 to 10 wt. %.

The agents improving fluidity which may be used in the toner of the present invention, which may be employed individually or in a combination, includes the known agents improving fluidity such as, for example, silica, titanium dioxide, silicon carbide, aluminum oxide, barium titanate and the like. Suitable content of the agent in the toner is from 0.1 to 5 wt. % to the total toner weight, and preferably from 0.5 to 2 wt. %.

Suitable manufacturing methods of the toner for use in the present invention include the known conventional producing methods.

For example, the manufacturing method is as follows:

(a) mix resins such as polyester resins, modified carnauba wax, and a hydrogenated petroleum resin, if desired, with a coloring agent, and a charge controlling agent in a mixer;

(b) melt and knead the mixture in a kneader of two-roll, an extruder or the like;

(c) after cooling, pulverize and classify the kneaded toner by a jet mill or the like; and (d) then, if desired, mix an agent improving fluidity and the toner in a mixer.

Having generally described this invention, a further understanding can be obtained by reference to certain specific examples which are provided herein for purpose of illustration only and are not intended to be limiting unless specified. In the descriptions in the following examples, numbers are weight ratios unless otherwise specified.

EXAMPLES

Example 1-1

A mixture of the following compounds was melted and kneaded in a extruder to form toner according to the present invention.

| | |
|---|---|
| polyester resin (A) (weight-average molecular weight 2,000, Tg 62° C., content of component insoluble in THF 3%, and acid value 25 mg KOH/g) | 45 |
| polyester resin (B) (weight-average molecular weight 15,500, Tg 50° C., and acid value 15 mg KOH/g) | 53 |
| low molecular weight polypropylene (VISCOLE 550P, manufactured by Sanyo Chemical Industries, Ltd.) | 5 |
| carbon black (#44, manufactured by Mitsubishi Kasei Corp.) | 10 |
| metal complex dye | 2 |

The kneaded mixture was cooled, pulverized in a fine grinder using jet air and subjected to an air classifier. Thus, black colored host particles having a volume-average particle diameter of 10.5 $\mu$m were obtained. Further, 0.5 parts of silica (R-972, manufactured by Nippon Aerosil Co.) were blended with 100 parts of black colored host particles mentioned above in a Henshel mixer, thus black colored toner was obtained.

Example 1-2

A mixture of the following compounds was melted and kneaded in the same way as Example 1-1.

| | |
|---|---|
| polyester resin (A) (weight-average molecular weight 12,000, Tg 59° C., content of component insoluble in THF 3%, and acid value 25 mg KOH/g) | 45 |
| polyester resin (B) (weight-average molecular weight 15,500, Tg 50° C., and acid value 5 mg KOH/g) | 38 |
| low molecular weight polypropylene (VISCOLE 550P, manufactured by Sanyo Chemical Industries, Ltd.) | 5 |
| carbon black (#44, manufactured by Mitsubishi Kasei Corp.) | 10 |
| metal complex dye | 2 |

Then this kneaded mixture was pulverized, classified and blended with silica in the same way as Example 1-1, thus black colored toner was obtained.

Comparative Example 1-1

A mixture of the following compounds was melt and kneaded in the same way as Example 1-1.

| | |
|---|---|
| polyester resin (A) (weight-average molecular weight 15,500, Tg 61° C., content of component insoluble in THF 0%, and acid value 25 mg KOH/g) | 42 |
| polyester resin (B) (weight-average molecular weight 8,000, Tg 63° C., and acid value 15 mg KOH/g) | 41 |
| low molecular weight polypropylene (VISCOLE 550P, manufactured by Sanyo Chemical Industries, Ltd.) | 5 |
| carbon black (#44, manufactured by Mitsubishi Kasei Corp.) | 10 |
| metal complex dye | 2 |

Then this kneaded mixture was pulverized, classified and blended with silica in the same way as Example 1-1, thus black colored toner was obtained.

Comparative Example 1-2

A mixture of the following compounds was melt and kneaded in the same way as Example 1-1.

| | |
|---|---|
| polyester resin (A) (weight-average molecular weight 8,500, Tg 55° C. content of material insoluble in THF 0%, and acid value 20 mg KOH/g) | 83 |
| low molecular weight polypropylene (VISCOLE 550P, manufactured by Sanyo Chemical Industries, Ltd.) | 5 |

Then this kneaded mixture was pulverized, classified and blended with silica in the same way as Example 1-1.

Example 1-3

A mixture of the following compounds was melted and kneaded in the same way as Example 1-1.

| | |
|---|---|
| polyester resin (A) (weight-average molecular weight 12,000, Tg 59° C., content of insoluble material in THF 3%, and acid value 5 mg KOH/g) | 45 |
| polyester resin (B) (weight-average molecular weight 5,500, Tg 50° C., and acid value 25 mg KOH/g) | 38 |
| low molecular weight polypropylene (VISCOLE 550P, manufactured by Sanyo Chemical Industries Ltd.) | 5 |
| carbon black (#44, Mitsubishi Kasei Corp.) | 10 |
| metal complex dye | 2 |

Then this kneaded mixture was pulverized, classified and blended with silica in the same way as Example 1-1.

Example 1-4

A mixture of the following compounds was melted and kneaded in the same way as Example 1-1.

| | |
|---|---|
| polyester resin (A) (weight-average molecular weight 10,000, Tg 59° C., content of insoluble material in THF 3%, and acid value 5 mg KOH/g) | 45 |
| polyester resin (B) (weight-average molecular weight 4,500, Tg 55° C., and acid value 25 mg KOH/g) | 38 |
| low molecular weight polypropylene | 5 |
| carbon black (#44, manufactured by Mitsubishi Kasei Corp.) | 10 |
| metal complex dye | 2 |

Then this kneaded mixture was pulverized, classified and blended with silica in the same way as Example 1-1.

Example 1-5

A mixture of the following compounds was melted and kneaded in the same way as Example 1-1.

| | |
|---|---|
| polyester resin (A) (weight-average molecular weight 15,000, Tg 59° C., content of insoluble component in THF 45%, and acid value 5 mg KOH/g) | 45 |
| polyester resin (B) (weight-average molecular weight 4,000, Tg 55° C., and acid value 35 mg KOH/g) | 38 |

-continued

| | |
|---|---|
| low molecular weight polypropylene | 5 |
| carbon black (#44, manufactured by Mitsubishi Kasei Corp.) | 10 |
| metal complex dye | 2 |

Then this kneaded mixture was pulverized, classified and blended with silica in the same way as Example 1-1.

Example 1-6

A mixture of the following compounds was melted and kneaded in the same way as Example 1-1.

| | |
|---|---|
| polyester resin (A) (weight-average molecular weight 15,000, Tg 59° C., content of insoluble material in THF 45%, and acid value 5 mg KOH/g) | 45 |
| polyester resin (B) (weight-average molecular weight 4,000, Tg 55° C., and acid value 35 mg KOH/g) | 38 |
| modified carnauba wax (melting point 82°C, and acid value 1 mg KOH/g) | 5 |
| carbon black (#44, manufactured by Mitsubishi Kasei Corp.) | 10 |
| metal complex dye | 2 |

Then this kneaded mixture was pulverized, classified and blended with silica in the same way as Example 1-1.

Example 1-7

A mixture of the following compounds was melted and kneaded in the same way as Example 1-1.

| | |
|---|---|
| polyester resin (A) (weight-average molecular weight 15,000, Tg 59° C., content of insoluble material in THF 45%, and acid value 5 mg KOH/g) | 40 |
| polyester resin (B) (weight-average molecular weight 4,000, Tg 55° C., and acid value 35 mg KOH/g) | 33 |
| hydrogenated petroleum resin (softening point 110° C., hydrogenation rate 95%, and including repeating units of dicyclopentadiene and an aromatic hydrocarbon) | 10 |
| modified carnauba wax (melting point 82° C., and acid value 1 mg KOH/g) | 5 |
| carbon black (#44, manufactured by Mitsubishi Kasei Corp.) | 10 |
| metal complex dye | 2 |

Then this kneaded mixture was pulverized, classified and blended with silica in the same way as Example 1-1.

In accordance with the following methods, each of the toner of the present invention obtained in Examples 1-1 through 1-7 and the comparative toner in Comparative Examples 1-1 and 1-2 was evaluated with respect to low temperature fixability, fixable temperature range and preservability.

(1) Low Temperature Fixability

Toner and silicone coated carrier in amounts of 3.0 parts and 97.0 parts, were mixed to form a two-component developer. After setting the developer in a developing unit of a copier, IMAGIO MF530™ (manufactured by Ricoh Co., Ltd.), images were printed at different fixing temperatures such that each image density of the images, measured by a reflection densitometer manufactured by Macbeth Co., was 1.2.

Each of the images image printed at different fixing temperatures was rubbed with an eraser including sand particles attached to a clock meter ten times, and measured the image density before and after rubbing to obtain;

fixing rate (%)={(image density after rubbing)/(image density before rubbing)}×100.

In addition, the lowest fixable temperature was defined as the lowest temperature which keep the fixing rate of at least 70%, (2) Fixable Temperature Range Toner and silicone coated carrier in amounts of 3.0 parts and 97.0 parts, were mixed to form a two-component developer. After the developer was set in a developing unit of a copier, IMAGIO MF530™ (manufactured by Ricoh Co., Ltd., but a function of coating silicone oil was eliminated therefrom), images were printed at different fixing temperatures and observed whether a hot offset image was generated. Fixable temperature range was defined as the temperature range between the lowest fixable temperature and minimum temperature of generating hot offset image.

(3) Preservability

After charging each toner in a glass container, set it in a temperature controlled box for 4 hours at 60° C. Then the toner cooled to 24° C. to measure the penetration by the penetration test method based on JIS K2235-1991. The larger the penetration became, the better the preservability of the toner.

The results are shown in Table 1.

TABLE 1

| | low temperature fixability | fixable temperature range (° C.) | heat preservability (mm) | diameter of a domain of resin (A) (μm) |
|---|---|---|---|---|
| Example 1-1 | 135 | 135–195 | 10 | 250 |
| Example 1-2 | 135 | 135~200 | 10 | 320 |
| Example 1-3 | 125 | 125~210 | 15 | 150 |
| Example 1-4 | 120 | 120~215 | 30 | 190 |
| Example 1-5 | 120 | 120~235 | 35 | 50 |
| Example 1-6 | 110 | 110~240 | 35 | 5 |
| Example 107 | 100 | 100~240 | 35 | 25 |
| Comparative Example 1-1 | 145 | 145~180 | 3 | 0(*) |
| Comparative Example 1-2 | 145 | 145~180 | 2 | 0(*) |

(*)No domain of resin (A) is formed.

The results in the Table 1 clearly indicate that the toner of the present invention includes a domain and exhibits such characteristics as excellent fixing properties and preservability.

Example 2-1

A mixture of the following compounds was melt and kneaded in the same way as Example 1-1.

| | |
|---|---|
| polyester resin (A) (weight-average molecular weight 12,000, Tg 59° C., content of insoluble component in THF 3%, and acid value 25 mg KOH/g) | 35 |
| polyester resin (B) (weight-average molecular weight 5,500, Tg 50° C., and acid value 5 mg KOH/g) | 30 |
| magnetizable material (average particle diameter 0.05 μm) | 25 |
| low molecular weight polypropylene (VISCOLE 550P, manufactured by Sanyo Chemical Industries Ltd.) | 5 |
| carbon black (#44, manufactured by Mitsubishi Kasei Corp.) | 3 |
| metal complex dye | 2 |

The kneaded mixture was cooled, pulverized in a fine grinder using jet air, and subjected to an air classifier. Thus black colored host particles having a volume-average particle diameter of 8.5 μm were obtained. Further, 0.5 parts of silica (R-972, manufactured by Nippon Aerosil Co.) were blended with 100 parts of black colored host particles mentioned above in a Henshel mixer, thus black colored toner was obtained.

Comparative Example 2-1

A mixture of the following compounds was melted and kneaded in the same way as Example 2-1.

| | |
|---|---|
| polyester resin (A) (weight-average molecular weight 8,500, Tg 55° C., content of insoluble component in THF 0%, and acid value 20 mg KOH/g) | 70 |
| magnetizable material (average particle diameter 0.40 μm) | 25 |
| low molecular weight polypropylene (VISCOLE 550P, manufactured by Sanyo Chemical Industries Ltd.) | 5 |
| carbon black (#44, manufactured by Mitsubishi Kasei Corp.) | 3 |
| metal complex dye | 2 |

Then this kneaded mixture was pulverized, classified and blended with silica in the same way as Example 2-1, thus black colored toner was obtained.

Example 2-2

A mixture of the following compounds was melt and kneaded in the same way as Example 2-1.

| | |
|---|---|
| polyester resin (A) (weight-average molecular weight 12,000, Tg 59° C., content of insoluble component in THF 3%, and acid value 5 mg KOH/g) | 35 |
| polyester resin (B) (weight-average molecular weight 5,500, Tg 50° C., and acid value 25 mg KOH/g) | 25 |
| magnetizable material (average particle diameter 0.03 μm) | 30 |
| low molecular weight polypropylene (VISCOLE 550P, manufactured by Sanyo Chemical Industries Ltd.) | 5 |
| carbon black (#44, manufactured by Mitsubishi Kasei Corp.) | 3 |
| metal complex dye | 2 |

Then this kneaded mixture was pulverized, classified and blended with silica in the same way as Example 2-1, thus black colored toner was obtained.

Example 2-3

A mixture of the following compounds was melt and kneaded in the same way as Example 2-1.

| | |
|---|---|
| polyester resin (A) (weight-average molecular weight 10,000, Tg 59° C., content of insoluble component in THF 3%, and acid value 5 mg KOH/g) | 35 |
| polyester resin (B) (weight-average molecular weight 4,500, Tg 55° C., and acid value 25 mg KOH/g) | 20 |
| magnetizable material (average particle diameter 0.02 μm) | 35 |
| low molecular weight polypropylene (VISCOLE 550P, manufactured by Sanyo Chemical Industries Ltd.) | 5 |
| carbon black (#44, manufactured by Mitsubishi Kasei Corp.) | 3 |
| metal complex dye | 2 |

Then this kneaded mixture was pulverized, classified and blended with silica in the same way as Example 2-1.

Example 2-4

A mixture of the following compounds was melt and kneaded in the same way as Example 1-1.

| | |
|---|---|
| polyester resin (A) (weight-average molecular weight 15,000, Tg 59° C., content of insoluble component in THF 45%, and acid value 5 mg KOH/g) | 35 |
| polyester resin (B) (weight-average molecular weight 4,000, Tg 55° C., and acid value 35 mg KOH/g) | 25 |
| magnetizable material (average particle diameter 0.02 μm) | 30 |
| low molecular weight polypropylene (VISCOLE 550P, manufactured by Sanyo Chemical Industries Ltd.) | 5 |
| carbon black (#44, manufactured by Mitsubishi Kasei Corp.) | 3 |
| metal complex dye | 2 |

Then this kneaded mixture was pulverized, classified and blended with silica in the same way as Example 2-1.

Example 2-5

A mixture of the following compounds was melt and kneaded in the same way as Example 1-1.

| | |
|---|---|
| polyester resin (A) (weight-average molecular weight 15,000, Tg 59° C., content of insoluble component in THF 45%, and acid value 5 mg KOH/g) | 35 |
| polyester resin (B) (weight-average molecular weight 4,000, Tg 55° C., and acid value 35 mg KOH/g) | 20 |
| magnetizable material (average particle diameter 0.20 μm) | 35 |
| modified carnauba wax (melting point 82° C., acid value 1 mg KOH/g) | 5 |
| carbon black (#44, manufactured by Mitsubishi Kasei Corp.) | 3 |
| metal complex dye | 2 |

Then this kneaded mixture was pulverized, classified and blended with silica in the same way as Example 2-1.

Example 2-6

A mixture of the following compounds was melt and kneaded in the same way as Example 1-1.

| | |
|---|---|
| polyester resin (A) (weight-average molecular weight 15,000, Tg 59° C., content of insoluble component in THF 45%, and acid value 5 mg KOH/g) | 35 |
| polyester resin (B) (weight-average molecular weight 4,000, Tg 55° C., and acid value 35 mg KOH/g) | 20 |
| hydrogenated petroleum resin (softening point 110° C., hydrogenation rate 95%, and including repeating units of dicyclopentadiene and an aromatic hydrocarbon) | 10 |
| magnetizable material (average particle diameter 0.20 μm) | 20 |
| modified carnauba wax (melting point 82° C., acid value 1 mg KOH/g) | 5 |
| carbon black (#44, manufactured by Mitsubishi Kasei Corp.) | 3 |
| metal complex dye | 2 |

Then this kneaded mixture was pulverized, classified and blended with silica in the same way as Example 2-1.

In accordance with the afore-mentioned and the following methods, each toner of the present invention obtained in Examples 2-1 to 2-6 and the comparative toner in Comparative Example 2-1 was evaluated with respect to low temperature fixability, fixable temperature range, preservability, fouling on printed images and toner scattering.

(1) Fouling on Printed Images

Toner and silicone coated carrier in amounts of 3.0 parts and 97.0 parts, were mixed to form a two-component developer. After setting the developer in a developing unit of a copier, IMAGIO MP530™ (manufactured by Ricoh Co., Ltd., but a function of coating silicone oil was eliminated therefrom), 50,000 copies were continuously printed. The background density of the last copied sheet was measured with a reflection densitometer manufactured by Macbeth Co. The background density of a copied sheet without fouling is 0.06, and the worse the fouling became, the greater the background density.

(2) Toner Scattering

After printing 50,000 copies above-mentioned, the scattered toner on a predetermined place of the developing unit over the developing sleeve was adhered to an adhesive tape and the optical density of the tape with toner was measured with a reflection densitometer manufactured by Macbeth Co.

The optical density of a tape without toner was 0.12, and the worse the toner scattering became, the greater the optical density.

The results are shown in Table 2.

TABLE 2

| | low temperature fixability (° C.) | fixable temperature range (° C.) | heat preservability (mm) | diameter of a domain of resin (A) (μm) | fouling on printed images | toner scattering |
|---|---|---|---|---|---|---|
| Example 2-1 | 140 | 140–200 | 15 | 240 | 0.07 | 0.14 |
| Example 2-2 | 130 | 130–210 | 21 | 300 | 0.07 | 0.13 |
| Example 2-3 | 125 | 125–210 | 32 | 130 | 0.06 | 0.13 |
| Example 2-4 | 125 | 125–215 | 37 | 170 | 0.06 | 0.13 |
| Example 2-5 | 115 | 115–235 | 38 | 40 | 0.06 | 0.12 |
| Example 2-6 | 105 | 105–240 | 36 | 10 | 0.06 | 0.12 |
| Comparative Example 2-1 | 150 | 150–180 | 35 | 0(*) | 0.12 | 0.25 |

(*)No domain of resin (A) is formed.

As observed from the Table 1 and 2, the image forming method of the present invention which includes two rollers in which a toner image is fixed at the nipped section of the two rollers, wherein one of the rollers which is a fixing roller to be contacted a toner image includes a metal cylinder having thickness of not more than 1.0 mm, and the fixing pressure of the two rollers is not more than $1.5\times10^5$ Pa, exhibits excellent performance such as, excellent low temperature fixability and wide fixable temperature range.

As observed from the Tables 1 and 2, the toner of the present invention which includes two polyester resins, (A) and (B), wherein the polyester resin (A) exists as domains within polyester resin (B) and preferably has higher Tg and molecular weight than those of the resin (B), and preferably includes a component insoluble in THF, has advantages such as excellent low temperature fixability, a wide fixable temperature range, and excellent preservability. This is particularly true as against the comparative example which has no domains.

Also as observed from the Table 2, the toner of the present invention which further includes a magnetizable material exhibits such characteristics as excellent image quality without fouling and apparatus contamination by toner scattering in addition to the afore-mentioned characteristics.

In addition, the toner of Examples 1-3 to 1-7 and 2-2 to 2-6 have superior fixing property and preservability because, it is thought, of the effects in which the acid value of the resin (A) is smaller than 20 mg KOH/g, and/or the acid value of the resin (B) is at least 20 mg KOH/g, and/or the Tg of the resin (B) is from 52 to 60° C., and/or the resin (A) includes a component insoluble in THF.

Further, it is observed that the addition of carnauba wax having free aliphatic acids eliminated therefrom and petroleum resin having a hydrogenation degree of at least 50% improve these fixing and preserving property.

Having now fully described the invention, it will be apparent to one of ordinary skill in the art that many changes and modifications can be made thereto without departing from the spirit and scope of the invention as set forth herein.

This application is based on Japanese Patent Applications 07-262214 filed on Sep. 14, 1995, and 08-050788 filed on Feb. 15, 1996, both incorporated herein by reference.

What is claimed as new and desired to be secured by Letters Patent of the United States is:

1. A dry toner comprising two polyester resins, (A) and (B), wherein said polyester resin (B) comprises discrete domains of said polyester resin (A), wherein said polyester resin (A) has a higher glass transition temperature Tg and higher weight-average molecular weight than polyester resin (B) and comprises a component insoluble in tetrahydrofuran.

2. The dry toner of claim 1, wherein each acid value of said polyester resin (A) and said polyester resin (B) is smaller than about 20 mg KOH/g and at least about 20 mg KOH/g, respectively.

3. The dry toner of claim 2, wherein the glass transition temperature Tg of said polyester resin (B) is from about 52 to 60° C.

4. The dry toner of claim 3, wherein said component insoluble in tetrahydrofuran is present in said polyester resin (A) in an amount of from about 5 to 60% by weight.

5. The dry toner of claim 4, wherein said dry toner further comprises carnauba wax which has been subjected to a treatment eliminating free aliphatic acids therefrom.

6. The toner of claim 5, wherein said dry toner further comprises a hydrogenated petroleum resin having a hydrogenation degree of at least about 50%.

7. The dry toner of claim 6, wherein said dry toner further comprises a magnetizable material having average particle diameter of from about 0.01 to 0.20 μm.

8. The dry toner of claim 6, wherein said petroleum resin is present in an amount of from about 5 to 50% by weight based on total weight of said dry toner.

9. The dry toner of claim 1, wherein the glass transition temperature Tg of said polyester resin (B) is from about 52 to 60° C.

10. The dry toner of claim 1, wherein said polyester resin (A) component insoluble in tetrahydrofuran is present in said polyester resin (A) in an amount of from about 5 to 60% by weight.

11. The dry toner of claim 1, wherein said dry toner further comprises carnauba wax which has been subjected to a treatment eliminating free aliphatic acids therefrom.

12. The dry toner of claim 11, wherein said dry toner further comprises a magnetizable material having average particle diameter of from about 0.01 to 0.20 μm.

13. The dry toner of claim 1, wherein said dry toner further comprises a hydrogenated petroleum resin having a hydrogenation degree of at least about 50%.

14. The dry toner of claim 13, wherein said dry toner further comprises a magnetizable material having average particle diameter of from about 0.01 to 0.20 μm.

15. The dry toner of claim 13, wherein the softening point of said petroleum resin is from about 90 to 140° C.

16. The dry toner of claim 13, wherein said petroleum resin comprises segments of dicyclopentadiene and aromatic hydrocarbon having from 6 to 8 carbon atoms.

17. The dry toner of claim 1, wherein said dry toner further comprises a magnetizable material having average particle diameter of from about 0.01 to 0.20 μm.

18. The dry toner of claim 1, wherein the weight-average molecular weight of said polyester resin (A) is from 3,000 to 50,000.

19. The dry toner of claim 1, wherein the glass transition temperature of said polyester resin (A) is from about 54 to 65° C.

20. An image forming method comprising fixing a developed toner image on an image supporting material by heating at a nipped section of two rollers, one of which is a fixing roller which contacts said developed toner image and includes a metal cylinder, said metal cylinder having a thickness of not more than 1.0 mm, and wherein the pressure between said two rollers is not more than $1.5\times10^5$ Pa, wherein said toner comprises a dry toner comprising two polyester resins, (A) and (B), wherein said polyester resin (B) comprises discrete domains of said polyester resin (A), and said polyester resin (A) has a higher glass transition temperature Tg and higher weight-average molecular weight than polyester resin (B) and comprises a component insoluble in tetrahydrofuran.

21. The method of claim 20, wherein each acid value of said polyester resin (A) and said polyester resin (B) is smaller than about 20 mg KOH/g and at least about 20 mg KOH/g, respectively.

22. The method of claim 21, wherein the glass transition temperature Tg of said polyester resin (B) is from about 52 to 60° C.

23. The method of claim 22, wherein said component insoluble in tetrahydrofuran is present in said polyester resin (A) in an amount of from about 5 to 60% by weight.

24. The method of claim 23, wherein said dry toner further comprises carnauba wax which has been subjected to a treatment eliminating free aliphatic acids therefrom.

25. The method of claim 24, wherein said dry toner further comprises a hydrogenated petroleum resin having a hydrogenation degree of at least about 50%.

26. The method of claim 25, wherein said dry toner further comprises a magnetizable material having average particle diameter of from about 0.01 to 0.20 μm.

27. The method of claim 25, wherein said petroleum resin is present in an amount of from about 5 to 50% by weight based on total weight of said dry toner.

28. The method of claim 20, wherein the glass transition temperature Tg of said polyester resin (B) is from about 52 to 60° C.

29. The method of claim 20, wherein said polyester resin (A) component insoluble in tetrahydrofuran is present in said polyester resin (A) in an amount of from about 5 to 60% by weight.

30. The method of claim 20, wherein said dry toner further comprises carnauba wax which has been subjected to a treatment eliminating free aliphatic acids therefrom.

31. The method of claim 30, wherein said dry toner further comprises a magnetizable material having average particle diameter of from about 0.01 to 0.20 μm.

32. The method of claim 20, wherein said dry toner further comprises a hydrogenated petroleum resin having a hydrogenation degree of at least about 50%.

33. The method of claim 32, wherein said dry toner further comprises a magnetizable material having average particle diameter of from about 0.01 to 0.20 μm.

34. The method of claim 32, wherein the softening point of said petroleum resin is from about 90 to 140° C.

35. The method of claim 32, wherein said petroleum resin comprises segments of dicyclopentadiene and aromatic hydrocarbon having from 6 to 8 carbon atoms.

36. The method of claim 20, wherein said dry toner further comprises a magnetizable material having average particle diameter of from about 0.01 to 0.20 μm.

37. The method of claim 20, wherein the weight-average molecular weight of said polyester resin (A) is from 3,000 to 50,000.

38. The method of claim 20, wherein the glass transition temperature of said polyester resin (A) is from about 54 to 65° C.

39. The method of claim 20, wherein the thickness of the metal cylinder is from 0.2 to 0.7 mm.

40. The method of claim 20, wherein the pressure is from $0.4\times10^5$ to $1.0\times10^5$ Pa.

* * * * *